US011401932B2

(12) United States Patent
Hoffmann et al.

(10) Patent No.: US 11,401,932 B2
(45) Date of Patent: Aug. 2, 2022

(54) SCREW PUMP WITH ABRADABLE COATING

(71) Applicant: AUDI AG, Ingolstadt (DE)

(72) Inventors: Thomas Hoffmann, Riedenburg (DE); Sebastian Wawersig, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 17/283,125

(22) PCT Filed: Dec. 5, 2019

(86) PCT No.: PCT/EP2019/083763
§ 371 (c)(1),
(2) Date: Apr. 6, 2021

(87) PCT Pub. No.: WO2020/126515
PCT Pub. Date: Jun. 25, 2020

(65) Prior Publication Data

US 2021/0388833 A1 Dec. 16, 2021

(30) Foreign Application Priority Data

Dec. 20, 2018 (DE) ..... 10 2018 222 516.8

(51) Int. Cl.
*F04C 2/16* (2006.01)
*F01P 5/10* (2006.01)

(52) U.S. Cl.
CPC ..... *F04C 2/16* (2013.01); *F01P 5/10* (2013.01); *F01P 2050/24* (2013.01); *F04C 2230/91* (2013.01)

(58) Field of Classification Search
CPC ..... F04C 2/16–165; F04C 18/16–165; F01C 1/16–165
See application file for complete search history.

(56) References Cited

U.S. PATENT DOCUMENTS 1,306,169 A * 6/1919 Brooks ..... F04C 2/16 418/202
2017/0241323 A1 8/2017 Yin et al.
2019/0345868 A1* 11/2019 Bauer ..... F01P 5/10

FOREIGN PATENT DOCUMENTS

DE 2905824 A1 11/1980
DE 10051731 A1 5/2002
(Continued)

OTHER PUBLICATIONS

German Examination Report dated Jul. 17, 2020 in corresponding German Application No. 10 2018 222 516.8; 10 pages; Machine translation attached.

(Continued)

*Primary Examiner* — Laert Dounis
(74) *Attorney, Agent, or Firm* — Maier & Maier, PLLC

(57) ABSTRACT

A drive device for a motor vehicle, having at least one drive unit and one coolant circuit for controlling the temperature of the at least one drive unit, in which at least one coolant pump is arranged in the coolant circuit for circulating an aqueous coolant in the coolant circuit. The coolant pump is designed as a screw spindle pump, in which one or more internal components are provided with a coating. The coating is designed to intentionally abrade during operation of the screw pump, thereby transferring the coating to uncoated components, while also retaining sufficient coating on the originally coated component.

20 Claims, 1 Drawing Sheet

(56) References Cited

FOREIGN PATENT DOCUMENTS

| | | | | | |
|---|---|---|---|---|---|
| DE | 10126482 | A1 | | 12/2002 | |
| DE | 20318594 | U1 | | 4/2004 | |
| DE | 102006049663 | A1 | | 5/2008 | |
| DE | 102009012916 | A1 | | 9/2010 | |
| DE | 102010011477 | A1 | | 9/2011 | |
| DE | 102011003206 | A1 | | 7/2012 | |
| EP | 1148243 | B1 | * | 6/2004 | ..... F04C 2/1071 |
| EP | 2336590 | A2 | | 6/2011 | |
| JP | 2002-129958 | A | | 5/2002 | |
| JP | 2002129958 | A | * | 5/2002 | |
| JP | 2008-089016 | A | | 4/2008 | |
| WO | WO-2015134412 | A1 | * | 9/2015 | ..... F01K 23/065 |

OTHER PUBLICATIONS

International Search Report (with English translation) and Written Opinion (with machine translation) dated Mar. 6, 2020 in corresponding International Application No. PCT/EP2019/083763; 17 pages.

Written Opinion dated Aug. 27, 2020 in corresponding International Application No. PCT/EP2019/083763; 12 pages; Machine translation attached.

International Preliminary Report on Patentability dated Jan. 26, 2021 in corresponding International Application No. PCT/EP2019/083763; 17pages.

Spandau Pumpen, "Optimize the flow", https://www.youtube.com/watch?v=4pzD4piSHWA Jun. 11, 2018; Screen shots attached.

Xingyang Wu et al., "Characteristics and tribological properties in water of Si-DLC coatings", Diamond and Related Materials, Elsevier Science Publishers; vol. 17, No. 1, Dec. 7, 2007; pp. 7-12.

L. Steiner et al., "Modelling of unlubricated oscillating sliding wear of DLC-coatings considering surface topography, oxidation and graphitisation", Wear, Elsevier Sequoia; vol. 268, No. 9-10, Mar. 25, 2010; pp. 1184-1194.

* cited by examiner

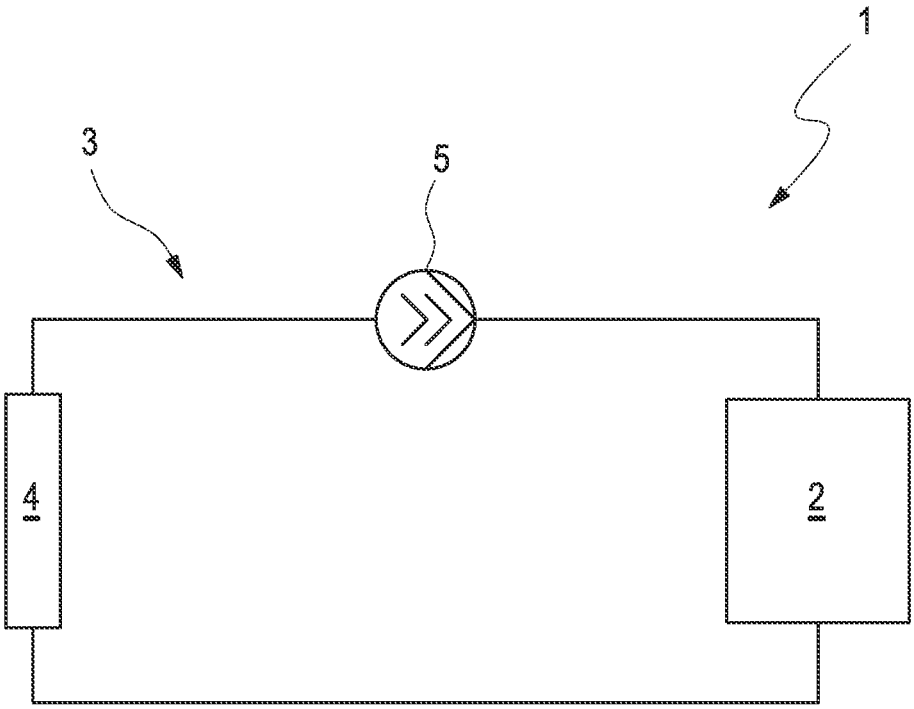
1
3
5
4
2

SCREW PUMP WITH ABRADABLE COATING

FIELD

The invention relates to a drive device for a motor vehicle, having at least one drive unit and one coolant circuit for controlling the temperature of the at least one drive unit, in which at least one coolant pump is arranged in the coolant circuit for circulating an aqueous coolant in the coolant circuit.

BACKGROUND

Publication DE 10 2010 011 477 A1, for example, is known from the prior art. This relates to an internal combustion engine having dry sump lubrication, which comprises a cylinder block and crankcase and an oil pump driven by the internal combustion engine, with at least one suction pump stage and one pressure pump stage, in which the at least one suction pump stage and the pressure pump stage within the cylinder block and crankcase are arranged in a common pump housing. In order to reduce the weight of the oil pump, it is proposed that the pump housing is an integral part of an oil pan or a lower part of the cylinder block and crankcase.

SUMMARY

The object of the invention is to propose a drive device for a motor vehicle, which has advantages over known drive devices, particularly which enables rapid adaptation of the coolant circuit to an operating point of the drive unit, has a very high degree of efficiency, and is additionally characterized by very good acoustic properties.

This is achieved according to the invention with a drive device for a motor vehicle. It is provided in this case that the coolant pump is designed as a screw spindle pump.

The drive device is used to drive the motor vehicle, that is to provide a drive torque directed toward powering of a motor vehicle. The drive torque is generated with the aid of the drive unit, in which the drive unit is designed, for example, as an internal combustion engine or—preferably—as an electric motor or has such. Additionally or alternatively, the drive unit may have a fuel cell. In any case, the drive unit is a heat-generating drive unit such that heat occurs during operation of the drive device, in or on the drive unit, which heat must be discharged therefrom.

A dissipation of the heat may also be provided additionally or alternatively. If both the dissipation and the supply of heat is provided, this can be characterized as temperature control. When a dissipation of heat is described within the scope of this description, this always stands as well for a dissipation and/or supply of heat or generally for temperature control. The thermal regulation of the heat takes place particularly such that a temperature of the drive unit is set at an operating temperature of the drive unit or is below said operating temperature. Preferably, the temperature of the drive unit is regulated to its operating temperature.

The dissipation and/or supply of heat takes place with the aid of the coolant circuit or by means of the coolant present in the coolant circuit, which is aqueous. Preferably, the coolant circuit is set such that it provides a cooling capacity for cooling the drive unit which maintains the temperature of the drive unit at or below the operating temperature. For example, the cooling capacity of the coolant circuit is effected by adjusting the coolant pump, for example by adjusting the rotational speed of the coolant pump. The higher the rotational speed of the coolant pump, the greater the volumetric flow of coolant which is circulated in the coolant circuit. Accordingly, the cooling capacity of the coolant circuit typically increases as the rotational speed of the coolant pump increases, at least with boundary conditions remaining the same. When the cooling capacity is discussed within the scope of this description, note that this term is understood to be the capacity of the coolant circuit regardless of whether it is being used to dissipate or to supply heat. Instead of the term cooling capacity, the phrase temperature-control capacity can generally also be used.

In order to achieve the previously mentioned advantages, the coolant pump should be present as a screw spindle pump. Such a screw spindle pump functions according to the displacement principle or it is present as a positive displacement pump. A high level of dynamics of the coolant circuit can hereby be achieved as compared to other types of pumps, for example circulator pumps which are typically used in this sector. This means that the coolant circuit can be adjusted substantially more rapidly to a changed operating point of the drive unit than is the case with other types of pumps, due to a change in the rotational speed of the coolant pump.

In addition, the screw spindle pump offers a higher degree of efficiency over the other types of pumps and has very good acoustic properties. Screw spindle pumps have not previously been used as coolant pumps, inter alia, because normal drive devices have weaknesses in the typical operating ranges. Thus, screw spindle pumps are less suitable for high volumetric flows and low counter-pressures, as they occur, for example, in the coolant circuits of internal combustion engines. Thus, primarily centrifugal pumps have been used in this area.

However, the applicant has surprisingly determined within the scope of tests that the screw spindle pump is also suitable for circulating the aqueous coolant in an excellent way and manner, in which simultaneously the aforementioned advantages are realized over other types of pumps. This applies particularly to drive devices, in which the screw spindle pump is present as an auxiliary pump, in addition to a primary pump, which is designed, for example, as a centrifugal pump, or in which the coolant circuit is only used for temperature control or cooling of a drive unit designed as an electric motor, i.e. particularly not the temperature control or cooling of an internal combustion engine.

In addition, the screw spindle pump has the advantage that a direction of flow can be reversed easily. It may also be provided that the screw spindle pump is sometimes operated with a first flow direction or conveying direction and sometimes with a second flow direction or conveying direction which is opposite the first flow direction. The reversal of the flow direction is achieved in a simple way and manner, for example, by means of a reversal in the direction of rotation.

Of course, the described coolant circuit cannot only be used once but multiple times within the scope of the drive device. The drive device thus has either precisely one coolant circuit as described or alternatively several. The several coolant circuits may be used for cooling different drive units. It is also possible that one of the coolant circuits is used for cooling the drive unit and at least one other of the coolant circuits is used for cooling an auxiliary unit which is needed for operating the drive unit. If the drive unit is present, for example, as an electric motor, then the auxiliary unit may be designed as a fuel cell, an energy storage device, a voltage converter, a control unit, an inverter, particularly a pulse-width-modulated inverter, or the like, which are connected to the electric motor and used for the operation thereof.

A further embodiment of the invention provides that the coolant pump has a drive screw coupled to a drive and at least one idle screw which interacts with the drive screw for circulating the coolant. The drive screw is coupled to the drive, for example, rigidly and permanently or in a switchable manner via a shift coupling. The drive unit itself, for example, is used as the drive, in which the drive screw is mechanically coupled to the drive unit or at least can be coupled. Additionally or alternatively, the drive screw can be coupled to an electric motor, preferably rigidly and permanently, which likewise represents the drive or is present as a supplement thereto.

The drive screw meshes with the at least one idle screw for circulating the coolant. Advantageously, only one single idle screw is a component of the screw spindle pump. Alternatively however, at least two idle screws may be present, which are arranged, for example, on opposite sides of the drive screw and each of which meshes therewith. In this case, the axes of rotation of the several idle screws and the drive screw are preferably in a common plane. With such type of design of the coolant pump, the previously mentioned advantages are realized in a simple way and manner.

A further embodiment of the invention provides that the drive unit has at least one of the following devices or is formed as such: internal combustion engine, electric motor, and fuel cells. In any case, the drive unit is used to provide the drive torque, either directly or indirectly. The direct provision can occur, for example, with the aid of the internal combustion engine or the electric motor, whereas the indirect provision can occur using the fuel cell. In the latter case, electrical energy is preferably provided with the aid of the fuel cell, which energy subsequently can be used to operate an electric motor in order to generate the drive torque. In this regard, the drive unit may comprise both the electric motor and the fuel cell. Also conceivable is an embodiment of the drive unit in which both the internal combustion engine and the electric motor are present. In this case, the drive unit is present as a hybrid drive unit. Such an embodiment of the drive device can be used extremely flexibly.

Of course, the coolant circuit can serve one or more of the following devices, in addition to the cooling and/or temperature control: energy storage device, particularly a high-voltage battery, voltage converter, control unit, and inverter, particularly a pulse-width-modulated inverter. Additionally or alternatively, the coolant circuit can be used for cooling charged air.

A refinement of the invention provides that the coolant pump has an output pressure of maximum 10 bar, maximum 7.5 bar, or maximum 5 bar. The term output pressure refers to the pressure which is present at a coolant outlet of the coolant pump. In other words, the output pressure corresponds to the pressure on a pressure side of the coolant pump. The output pressure is preferably the highest pressure prevailing in the coolant circuit. Compared to other pumps of the drive device, the coolant pump is provided and designed for a comparatively low output pressure. Thus, the output pressure should be a maximum of 10 bar or less. Especially preferably, the output pressure is less than 5 bar, for example maximum 4 bar or maximum 3 bar. An output pressure of maximum 2.5 bar or maximum 2 bar may also be provided. Such a low output pressure is surprisingly easy to realize with the aid of the screw spindle pump, in which the embodiment of the coolant pump as a screw spindle pump enables significant energy savings due to the high efficiency of these pumps. For example, the output pressure is at least 1.5 bar at least 2 bar, or more.

Within the scope of a further embodiment of the invention, it is provided that at least one or precisely one of the following screws has a coating: drive screw and idle screw. In order to achieve a long service life of the screw spindle pump, the drive screw and/or the idle screw has the coating. It may be provided that several of the screws or all of the screws each have the coating. Especially preferably, the coating is only applied, however, to one part of the screws, particularly to precisely one of the screws. If precisely one idle screw is present, the coating can either be on the drive screw or the idle screw. On the other hand, if several idle screws are provided, preferably exclusively the drive screw has the coating.

The coating is especially preferably designed such that it is transferred from the screw having the coating to the other screw or the other screws during operation of the coolant pump. Thus, the coating is discharged from the screw having the coating to the other screw or the other screws. Additionally or alternatively, the coating can transfer from the respective screw to a housing of the coolant pump. The provision of the coating for only one part of the screws or precisely one of the screws prevents the screws from jamming together and/or against the housing, which could otherwise occur due to tight tolerances. With the aid of the coating, a screw spindle pump can be realized with an extremely long service life which is also well protected against corrosion.

A further embodiment of the invention provides that the coating is placed on a main body of the screw, and that the screw is formed with transition fit or gap fit to a housing of the coolant pump, in which the screw is rotatably mounted. The screw has both the main body and the coating applied to the main body. For example, the main body is designed to be undersized or with a transition fit to the housing. The coating is applied to the main body such that the screw as a whole continues to be present with a transition fit or gap fit to the housing.

Particularly in the case of the transition fit, this means that an operation of the coolant pump also initially results in abrasion of the screw, particularly of the coating. Especially preferably, the coating is applied to the main body with a thickness or a layer thickness such that at least one part of the coating remains on the main body after run-in of the screw. In this respect, an embodiment of the main body which is undersized as relates to the housing is especially preferred. The coating is preferably applied to the main body with a low tolerance, particularly with respect to roundness and cylindrical shape. Additionally or alternatively, it may have a very small layer thickness, particularly a layer thickness of maximum 10 μm, maximum 1 μm, or less. Especially low tolerances of the coolant pump and thus an especially high level of efficiency or conveying capacity are achieved due to the abrasion of the coating during the run-in of the coolant pump.

A further preferred embodiment of the invention provides that the main body consists of plastic or metal or has plastic or metal. The main body may consist thoroughly either of plastic or of metal. However, it may also be provided that it only has plastic or metal, or only contains plastic or metal. For example, the main body in this case has a predominant portion, i.e. more than 50%, made of plastic or metal. An embodiment of the main body made of plastic is especially preferred for weight reasons. Essentially, a corrosion-resistant material is preferred which is resistant to the coolant in the long term. A corrosion-resistant material is also used preferably for the housing, for example the same material as for the main body. Of course, the housing may consist, however, of a different material.

One refinement of the invention provides that the coating consists of carbon or has carbon. For example, the coating is present in the form of amorphous carbon, particularly as diamond-like carbon (DLC). In this case, the coating is applied to the main body especially preferably through vapor deposition. The coating made of carbon enables an especially long service life of the coolant pump. In addition, the coating enables a reduction in friction such that a higher degree of efficiency results.

A further embodiment of the invention provides that the coolant predominantly contains water. This means that the coolant consists of at least 50% water. Especially preferably, the water portion in the coolant corresponds to at least 90% or at least 99%. The remainder of the coolant is preferably composed of at least one additive and unavoidable impurities, in which the impurities have a portion of maximum 1% of the coolant. Water is characterized by an especially high heating capacity and thus an especially high cooling effect.

Finally, it may be provided within the scope of a further embodiment of the invention that at least one additive, particularly glycol, is mixed in with the water. The additive is used particularly for lubrication of the coolant pump, the production of frost resistance of the coolant, and/or the implementation of corrosion protection.

BRIEF DESCRIPTION OF THE FIGURE(S)

The invention is explained in more detail in the following by means of exemplary embodiments shown in the drawing, without limiting the invention. In doing so, the only FIGURE shows a schematic representation of a drive device for a motor vehicle.

DETAILED DESCRIPTION

The FIGURE shows a schematic representation of a drive device 1 for a motor vehicle. The drive device 1 has a drive unit 2, to which a coolant circuit 3 is assigned for the temperature control of the drive unit. The coolant circuit 3 has a radiator 4, i.e. ultimately a heat exchanger, as well as a coolant pump 5 for circulating an aqueous coolant in the coolant circuit 3.

It can be seen that the coolant pump 5 is designed as a screw spindle pump within the scope of the drive devices 1 shown herein. Such a pump has numerous advantages over other types of pumps; particularly, it functions according to the displacement principle such that a high level of dynamics of the coolant circuit 3 can be realized. In addition, it has a very high degree of efficiency and extremely good acoustic characteristics. These advantages can surprisingly also be implemented within the scope of the coolant circuit 3 presented herein. Screw spindle pumps have not previously been used for such coolant circuits 3.

LIST OF REFERENCE NUMERALS

1 Drive device
2 Drive unit
3 Coolant circuit
4 Radiator
5 Coolant pump

The invention claimed is:

1. A drive device for a motor vehicle, comprising:
at least one drive unit, and
one coolant circuit for controlling the temperature of the at least one drive unit,
wherein at least one coolant pump is arranged in the coolant circuit for circulating a coolant in the coolant circuit,
wherein the coolant pump is designed as a screw spindle pump comprising a drive screw coupled to a drive and at least one idle screw which interacts with the drive screw for circulating the coolant,
wherein a main body of the drive screw and/or the at least one idle screw is formed from plastic,
wherein at least one of the drive screw and the at least one idle screw are provided with a coating,
wherein the coating is configured to be abraded in order to coat those of the drive screw and the at least one idle screw which are not provided with the coating.

2. The drive device according to claim 1, wherein the drive unit comprises at least one of an internal combustion engine, an electric motor, and at least one fuel cell.

3. The drive device according to claim 1, wherein the coolant pump has a maximum output pressure of 10 bar.

4. The drive device according to claim 1, wherein the coating is provided on the main body of the drive screw and/or the at least one idle screw, and
wherein the drive screw and/or the at least one idle screw provided with the coating is formed having a transition fit to a housing of the coolant pump which purposefully abrades the coating.

5. The drive device according to claim 1, wherein the coating comprises carbon.

6. The drive device according to claim 1, wherein the coolant is at least 50% water.

7. The drive device according to claim 1, wherein the coolant further contains glycol.

8. The drive device according to claim 1, wherein only one of the drive screw and the at least one idle screw are provided with the coating.

9. The drive device according to claim 8, wherein the coating is provided on the main body of the drive screw or the at least one idle screw, and
wherein the drive screw or the at least one idle screw provided with the coating is formed having a transition fit to a housing of the coolant pump which purposefully abrades the coating.

10. The drive device according to claim 4, wherein the main body of the drive screw and/or the at least one idle screw is undersized with respect to the housing.

11. The drive device according to claim 9, wherein the main body of the drive screw or the at least one idle screw is undersized with respect to the housing.

12. The drive device according to claim 1, wherein the coating has a maximum layer thickness of 10 μm.

13. The drive device according to claim 10, wherein the coating has a maximum layer thickness of 10 μm.

14. The drive device according to claim 11, wherein the coating has a maximum layer thickness of 10 μm.

15. The drive device according to claim 1, wherein the coating comprises amorphous carbon.

16. The drive device according to claim 4, wherein the coating comprises amorphous carbon.

17. The drive device according to claim 9, wherein the coating comprises amorphous carbon.

18. The drive device according to claim 15, wherein the coolant is at least 50% water and further comprises glycol.

19. The drive device according to claim 16, wherein the coolant is at least 50% water and further comprises glycol.

20. The drive device according to claim 17, wherein the coolant is at least 50% water and further comprises glycol.

* * * * *